US012660935B1

(12) United States Patent
Barrett

(10) Patent No.: US 12,660,935 B1
(45) Date of Patent: Jun. 23, 2026

(54) BED MATTRESS

(71) Applicant: London Barrett, Virginia Beach, VA (US)

(72) Inventor: London Barrett, Virginia Beach, VA (US)

( * ) Notice: Subject to any disclaimer, the term of this patent is extended or adjusted under 35 U.S.C. 154(b) by 78 days.

(21) Appl. No.: 18/588,272

(22) Filed: Feb. 27, 2024

(51) Int. Cl.
*A47C 27/00* (2006.01)

(52) U.S. Cl.
CPC ..... *A47C 27/001* (2013.01); *A47C 27/00* (2013.01)

(58) Field of Classification Search
CPC ..... A47C 27/001; A47C 27/00
USPC ..... 6/723, 722, 691, 690; 5/723, 722, 691, 5/690
See application file for complete search history.

(56) References Cited

U.S. PATENT DOCUMENTS

| | | | | |
|---|---|---|---|---|
| 3,056,146 | A * | 10/1962 | Steckart | A47C 27/05 5/717 |
| 3,058,123 | A | 10/1962 | Pink | |
| 3,106,724 | A | 10/1963 | Kamp | |
| 4,728,161 | A | 3/1988 | Murphy | |
| 5,152,592 | A | 10/1992 | Krayer | |
| D405,623 | S | 2/1999 | Zaidman | |
| 5,953,779 | A * | 9/1999 | Schwartz | A47C 27/001 5/722 |
| 6,931,676 | B1 | 8/2005 | Henley, Jr. | |
| 8,181,294 | B1 * | 5/2012 | Johnson | A47C 31/105 5/692 |
| 12,022,956 | B2 * | 7/2024 | Rocco | A47C 17/045 |
| 2013/0269114 | A1 * | 10/2013 | Wu | A47C 27/001 5/723 |
| 2015/0320228 | A1 * | 11/2015 | Kilgore | A47C 27/148 5/722 |
| 2021/0321788 | A1 * | 10/2021 | Luigi | A47C 27/14 |

FOREIGN PATENT DOCUMENTS

| | | |
|---|---|---|
| CA | 697303 | 11/1964 |

* cited by examiner

*Primary Examiner* — Robert G Santos

(57) ABSTRACT

The improved bed mattress is configured for use in a chamber. The improved bed mattress is a configurable structure. By configurable is meant that the form factor of the improved bed mattress is adjustable. The improved bed mattress can be configured to fit into a corner of the chamber such that the improved bed mattress fits flush against surfaces of the walls that form the corner of the chamber. The improved bed mattress incorporates a mattress structure and a plurality of fastening devices. The mattress structure forms the multi-component structure of the improved bed mattress. The plurality of fastening devices attach the individual components of the multi-component structure of the improved bed mattress to each other.

6 Claims, 4 Drawing Sheets

BED MATTRESS

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of corner seating furniture. (A47C15/002)

SUMMARY OF INVENTION

The improved bed mattress is a multi-component mattress. The improved bed mattress is configured for use in a chamber. The improved bed mattress is a configurable structure. By configurable is meant that the form factor of the improved bed mattress is adjustable. The improved bed mattress can be configured to fit into a corner of the chamber such that the improved bed mattress fits flush against surfaces of the walls that form the brink of the corner of the chamber. The improved bed mattress comprises a mattress structure and a plurality of fastening devices. The mattress structure forms the multi-component structure of the improved bed mattress. The plurality of fastening devices attach the individual components of the multi-component structure of the improved bed mattress to each other.

These together with additional objects, features and advantages of the improved bed mattress will be readily apparent to those of ordinary skill in the art upon reading the following detailed description of the presently preferred, but nonetheless illustrative, embodiments when taken in conjunction with the accompanying drawings.

In this respect, before explaining the current embodiments of the improved bed mattress in detail, it is to be understood that the improved bed mattress is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the improved bed mattress.

It is therefore important that the claims be regarded as including such equivalent construction insofar as they do not depart from the spirit and scope of the improved bed mattress. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
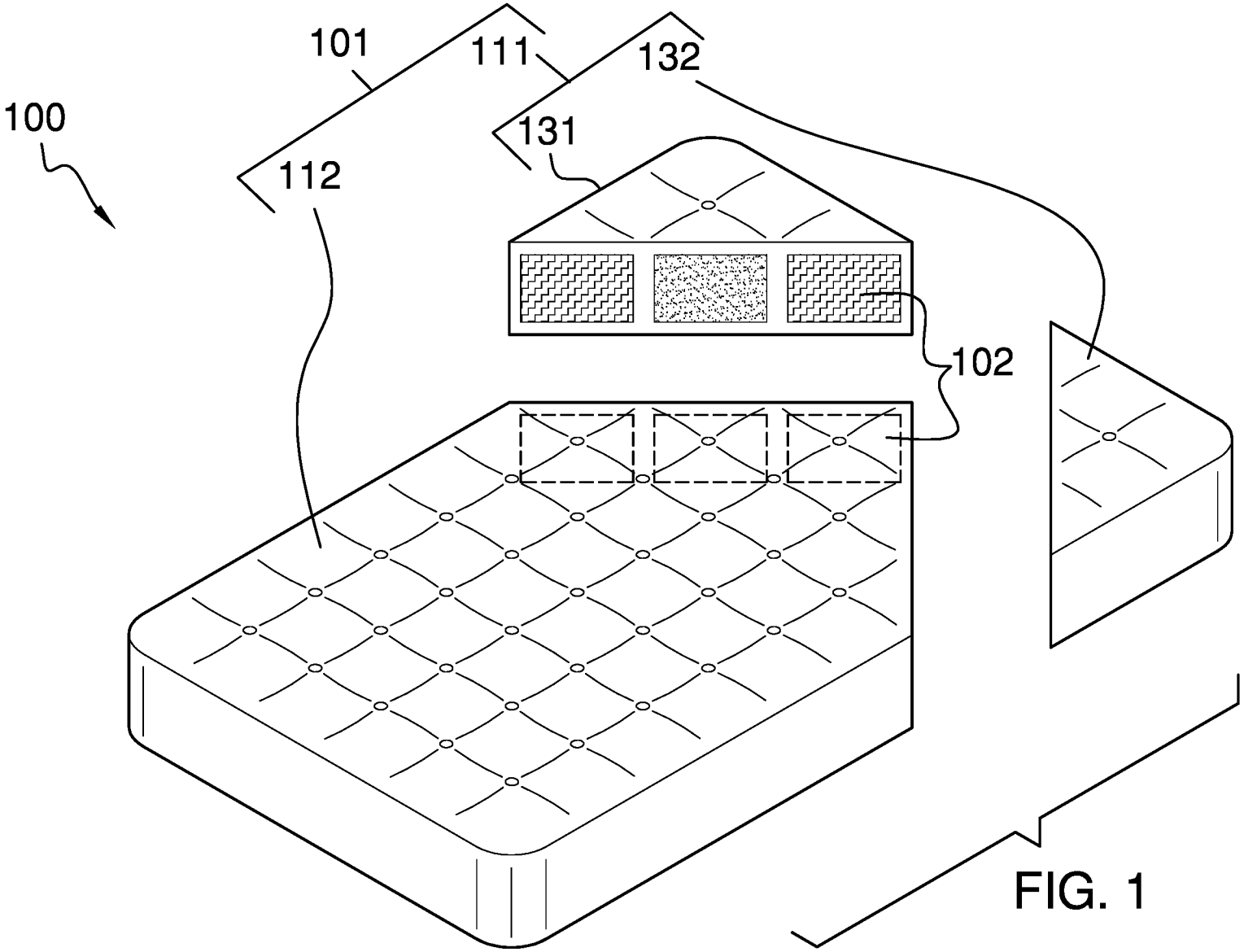
FIG. 1 is a perspective view of an embodiment of the disclosure.
Figure 2:
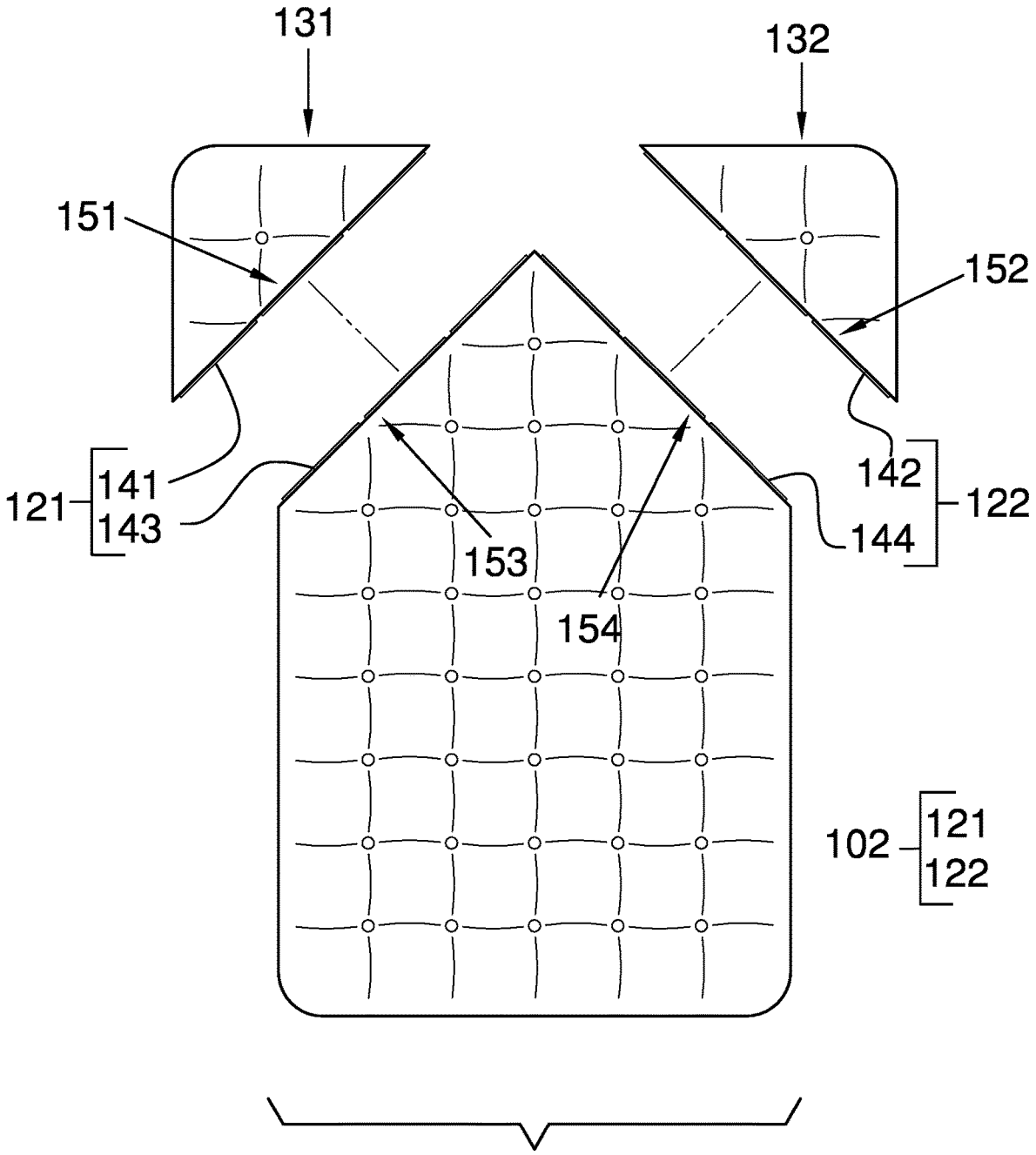
FIG. 2 is an exploded view of an embodiment of the disclosure.
Figure 3:
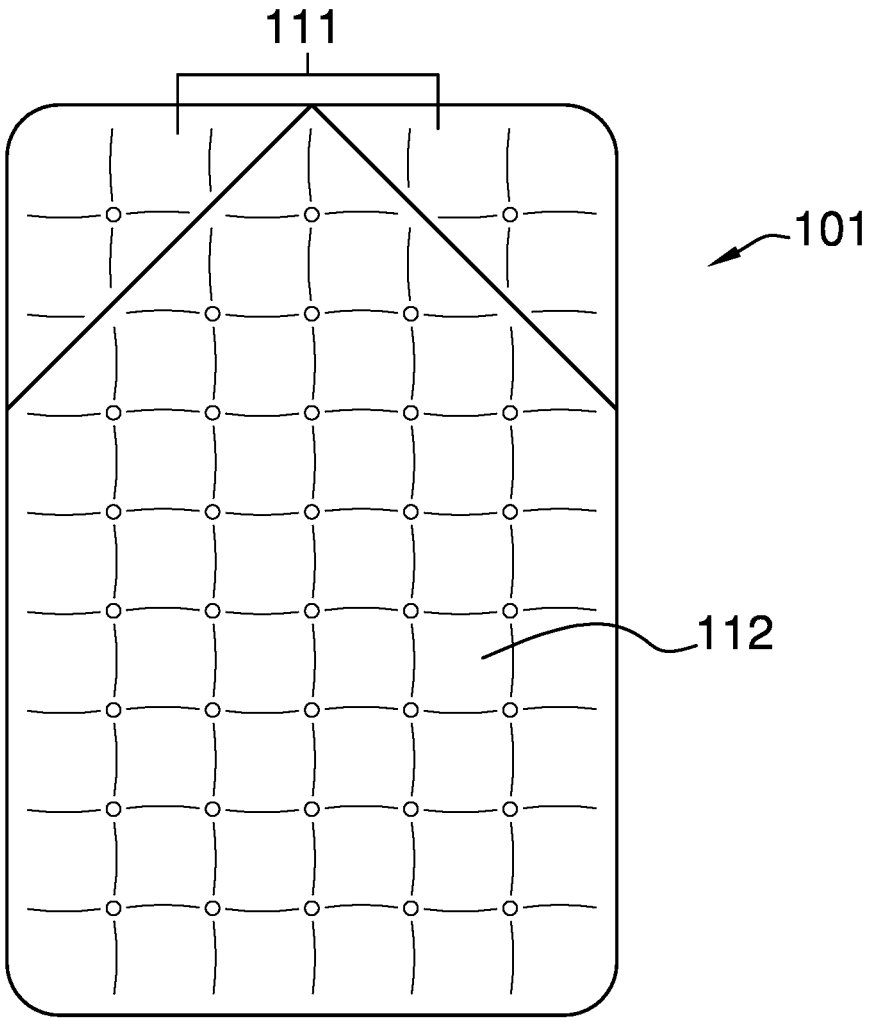
FIG. 3 is a top view of an embodiment of the disclosure.
Figure 4:
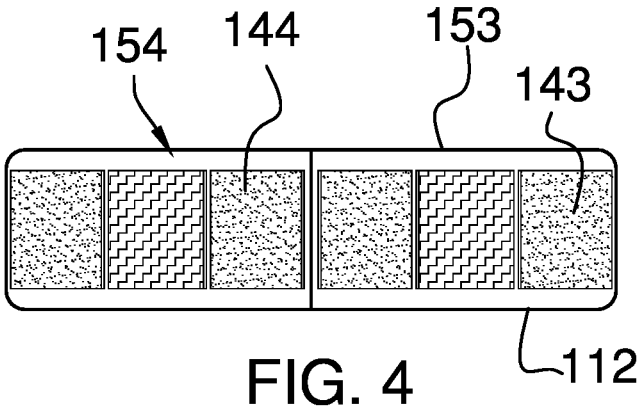
FIG. 4 is a side view of an embodiment of the disclosure.
Figure 5:
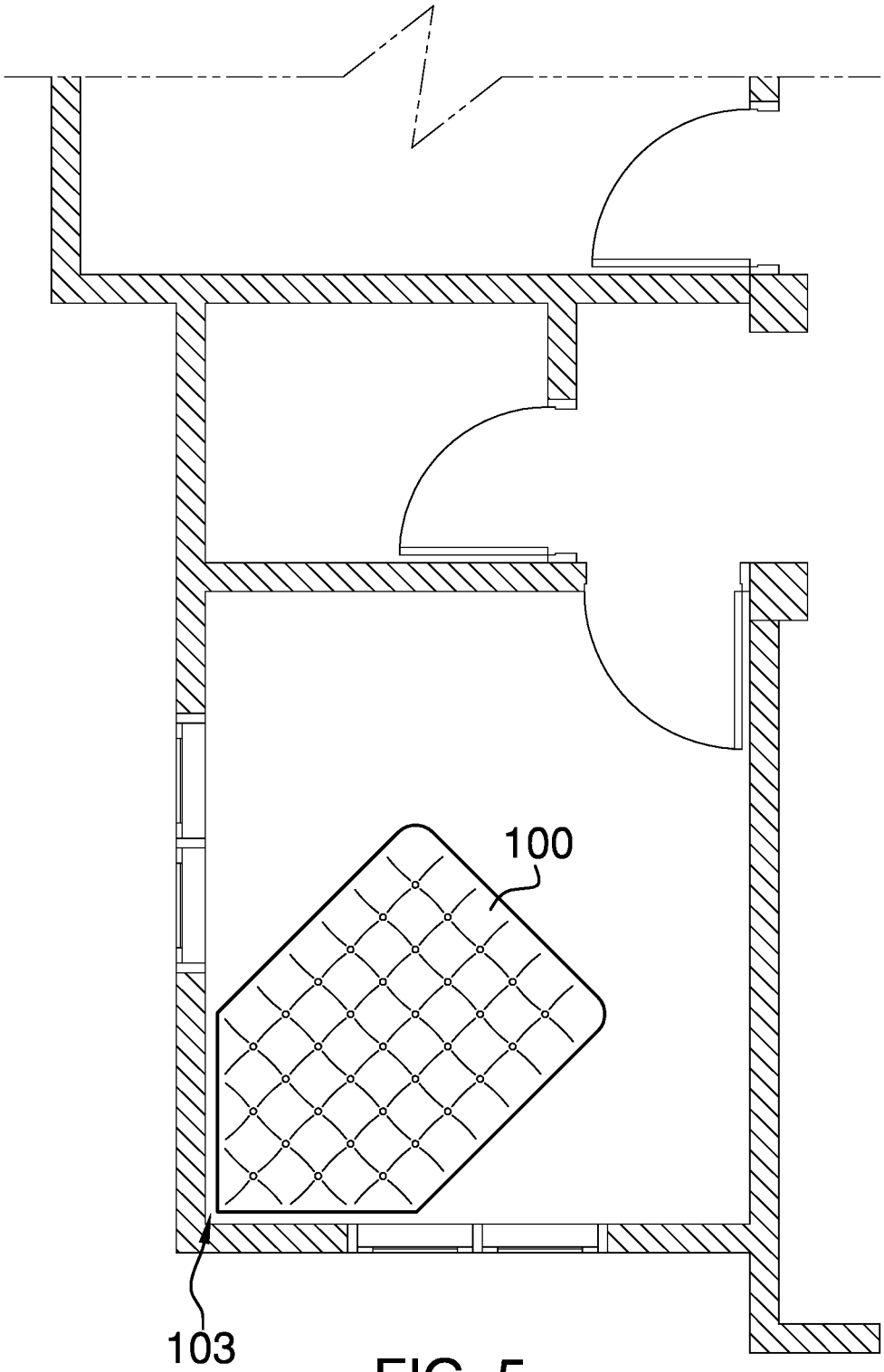
FIG. 5 is an in-use view of an embodiment of the 16 disclosure.

Detailed reference will now be made to one or more potential embodiments of the disclosure, which are illustrated in FIGS. 1 through 5.

The improved bed mattress 100 (hereinafter invention) is a multi-component mattress. The invention 100 is configured for use in a chamber 103. The invention 100 is a configurable structure. By configurable is meant that the form factor of the invention 100 is adjustable. The invention 100 can be configured to fit into a corner of the chamber 103 such that the invention 100 fits flush against surfaces of the walls that form the brink of the corner of the chamber 103. The invention 100 comprises a mattress structure 101 and a plurality of fastening devices 102. The mattress structure 101 forms the multi-component structure of the invention 100. The plurality of fastening devices 102 attach the individual components of the multi-component structure of the invention 100 to each other.

The mattress structure 101 forms a horizontally oriented supporting surface. The mattress structure 101 forms a cushioned surface. The mattress structure 101 forms the multi-component mattress structure of the invention 100. The fully assembled mattress structure 101 forms a disk structure. The fully assembled mattress structure 101 forms a lateral disk structure. The fully assembled mattress structure 101 has a rectangular disk shape. The mattress structure 101 comprises a plurality of truncated mattress substructures 111 and a core mattress substructure 112. The plurality of truncated mattress substructures 111 removably attach to the core mattress substructure 112.

Each truncated mattress substructure selected from the plurality of truncated mattress substructures 111 forms a horizontally oriented supporting surface. Each selected truncated mattress substructure forms a cushioned surface. Each selected truncated mattress substructure is a disk shaped structure. Each selected truncated mattress substructure removably attaches to the core mattress substructure 112 to form a lateral disk structure. Each selected truncated mattress substructure has a triangular shape. Each selected truncated mattress substructure is formed from the bifurcation of a vertex of the rectangular disk structure of the mattress structure 101. The selected truncated mattress substructure is formed from the truncation of the vertex of the mattress structure 101.

The full rectangular disk structure of the mattress structure 101 is formed when all the truncated mattress substructures selected from the plurality of truncated mattress substructures 111 are attached to the mattress structure 101. The form factor of the mattress structure 101 adjusts by adding and removing one or more truncated mattress substructures selected from the plurality of truncated mattress substructures to the mattress structure 101.

The plurality of truncated mattress substructures 111 further comprises a first truncated mattress substructure 131 and a second truncated mattress substructure 132.

The first truncated mattress substructure 131 forms a horizontally oriented supporting surface. The first truncated mattress substructure 131 forms a cushioned surface. The first truncated mattress substructure 131 is a disk shaped structure. The first truncated mattress substructure 131 has a triangular shape. The first truncated mattress substructure 131 removably attaches to the core mattress substructure 112 to form a lateral disk structure. The first truncated mattress substructure 131 changes the form factor of the mattress structure 101 when the first truncated mattress substructure 131 attaches to the core mattress substructure 112. The first truncated mattress substructure 131 changes the form factor of the mattress structure 101 when the first truncated mattress substructure 131 is removed from the core mattress substructure 112. The first truncated mattress substructure 131 further comprises a first truncated surface 151.

The first truncated surface 151 is a lateral face of the disk structure of the first truncated mattress substructure 131. The first truncated surface 151 is the face of the first truncated mattress substructure 131 that is formed by the furcation of the first truncated mattress substructure 131 from the rectangular disk structure of the assembled mattress structure 101.

The second truncated mattress substructure 132 forms a horizontally oriented supporting surface. The second truncated mattress substructure 132 forms a cushioned surface. The second truncated mattress substructure 132 is a disk shaped structure. The second truncated mattress substructure 132 has a triangular shape. The second truncated mattress substructure 132 removably attaches to the core mattress substructure 112 to form a lateral disk structure. The second truncated mattress substructure 132 changes the form factor of the mattress structure when the second truncated mattress substructure 132 attaches to the core mattress substructure 112. The second truncated mattress substructure 132 changes the form factor of the mattress structure 101 when the second truncated mattress substructure is removed from the core mattress substructure 112. The second truncated mattress substructure 132 further comprises a second truncated surface 152.

The second truncated surface 152 is a lateral face of the disk structure of the second truncated mattress substructure 132. The second truncated surface 152 is the face of the second truncated mattress substructure 132 that is formed by the 8 furcation of the second truncated mattress substructure 132 from the rectangular disk structure of the assembled mattress structure 101.

The core mattress substructure 112 forms a horizontally oriented supporting surface. The core mattress substructure 112 forms a cushioned surface. The core mattress substructure 112 is a disk shaped structure. The core mattress substructure 112 has an irregular disk shape. The core mattress substructure 112 is formed with an apex. The apex of the core mattress substructure 112 allows the core mattress substructure 112 to fit into the corner of the chamber 103 such that a subset of the lateral faces of the disk structure of the core mattress substructure 112 fit flush against the walls that form the brink of the corner of the chamber 103. The core mattress substructure 112 further comprises a third truncated surface 153 and a fourth truncated surface 154.

The third truncated surface 153 is a lateral face of the disk structure of the core mattress substructure 112. The first truncated surface 151 is geometrically identical to the third truncated surface 153 of the core mattress substructure 112. The third truncated surface 153 is the face of the core mattress substructure 112 that is formed by furcated separation of the first truncated mattress substructure 131 from the core mattress substructure 112.

The fourth truncated surface 154 is a lateral face of the disk structure of the core mattress substructure 112. The second truncated surface 152 is geometrically identical to the fourth truncated surface 154 of the core mattress substructure 112. The fourth truncated surface 154 is the face of the core mattress substructure 112 that is formed by furcated separation of the second truncated mattress substructure 132 from the core mattress substructure 112.

The plurality of fastening devices 102 comprises a collection of fastening devices. Each plurality of fastening devices 102 removably attaches the plurality of truncated 19 mattress substructures 111 to the core mattress substructure 112. The form factor of the mattress structure 101 adjusts by adding and removing one or more truncated mattress substructures selected from the plurality of truncated mattress substructures 111 to the core mattress substructure 112. The plurality of fastening devices 102 attaches each selected truncated mattress substructure to the core mattress substructure 112 to form the lateral disk structure of the mattress structure 101. The plurality of fastening devices 102 comprises a first hook and loop fastener 121 and a second hook and loop fastener 122.

The first hook and loop fastener 121 is a fastening device selected from the plurality of fastening devices 102. The first hook and loop fastener 121 is a hook and loop fastener. The 8 first hook and loop fastener 121 removably attaches the first truncated mattress substructure 131 to the third truncated surface 153 of the core mattress substructure 112.

The first hook and loop fastener 121 further comprises a first hook/loop surface and a second hook/loop surface 143. The first hook/loop surface 141 is a hook/loop surface associated with the first hook and loop fastener 121. The first hook/loop surface 141 permanently attaches to the first truncated surface 151 of the first truncated mattress substructure 131. The second hook/loop surface 143 is a hook/loop surface associated with the first hook and loop fastener 121. The second hook/loop surface 143 permanently attaches to the third truncated surface 153 of the core mattress substructure 112. The first hook and loop fastener 121 attaches the first truncated surface 151 to the third truncated surface 153 by pressing the first hook/loop surface 141 into the second hook/loop surface 143.

The second hook and loop fastener 122 is a fastening device selected from the plurality of fastening devices 102. The second hook and loop fastener 122 is a hook and loop fastener. The second hook and loop fastener 122 removably attaches the second truncated mattress substructure 132 to the fourth truncated surface 154 of the core mattress substructure 112.

The second hook and loop fastener 122 further comprises a 9 third hook/loop surface 143 and a third hook/loop surface 143. The second hook and loop fastener 122 further comprises a third hook/loop surface 142 and a fourth hook/loop surface 144. The third hook/loop surface is a hook/loop surface associated with the second hook and loop fastener 122. The third hook/loop surface 142 permanently attaches to the second truncated surface 152 of the second truncated mattress substructure 132. The fourth hook/loop surface 144 is a hook/loop surface associated with the second hook and loop fastener 122. The fourth hook/loop surface 144 permanently attaches to the fourth truncated surface 154 of the core mattress substructure 112. The second hook and loop fastener attaches the second truncated surface 152 to the fourth truncated surface 154 by pressing the fourth hook/loop surface 144 into the third hook/loop surface 142.

The following definitions were used in this disclosure:

Align: As used in this disclosure, align refers to an arrangement of objects that are: 1) arranged in a straight plane or line; 2) arranged to give a directional sense of a plurality of parallel planes or lines; or, 3) a first line or curve is congruent to and overlaid on a second line or curve.

Apex: As used in this disclosure, an apex is a vertex that forms an extreme or solitary point of an object.

Bifurcate: As used in this disclosure, to bifurcate means to divide an object or space into two pieces or segments.

Brink: As used in this disclosure, a brink refers to the edge or line formed by the intersection of a first plane or surface and a second plane or surface wherein a cant exists between the first plane or surface and the second plane or surface.

Cant: As used in this disclosure, a cant is an angular deviation from one or more reference lines (or planes) such as a vertical line (or plane) or a horizontal line (or plane). Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; 4) the point, pivot, or axis around which something revolves; or, 5) the centroid or first moment of an area or structure. In cases where the appropriate definition or definitions are not obvious, the fifth option should be used in interpreting the specification.

Center Axis: As used in this disclosure, the center axis is the axis of a cylinder or a prism. The center axis of a prism is the line that joins the center point of the first congruent face of the prism to the center point of the second corresponding congruent face of the prism. The center axis of a pyramid refers to a line formed through the apex of the pyramid that is perpendicular to the base of the pyramid. When the center axes of two cylinder, prism or pyramidal structures share the same line they are said to be aligned. When the center axes of two cylinder, prism or pyramidal structures do not share the same line they are said to be offset.

Chamber: As used in this disclosure, a chamber is an enclosed or enclosable space within a building.

Composite Prism: As used in this disclosure, a composite prism refers to a structure that is formed from a plurality of structures selected from the group consisting of a prism structure, a pyramid structure, and a spherical structure. The plurality of selected structures may or may not be truncated or bifurcated. The plurality of prism structures are joined together such that the center axes of each of the plurality of structures are aligned. The congruent ends of any two structures selected from the group consisting of a prism structure and a pyramid structure need not be geometrically 2 similar.

Congruent: As used in this disclosure, congruent is a term that compares a first object to a second object. Specifically, two objects are said to be congruent when: 1) they are geometrically similar; and, 2) the first object can superimpose over the second object such that the first object aligns, within manufacturing tolerances, with the second object.

Correspond: As used in this disclosure, the term correspond is used as a comparison between two or more objects wherein one or more properties shared by the two or more objects match, agree, or align within acceptable manufacturing tolerances.

Cushion: As used in this disclosure a cushion is a pad or pillow formed from soft material that is used for resting, sleeping, or reclining. A cushion can also be used to prevent injury or damage.

Disk: As used in this disclosure, a disk is a prism-shaped object that is flat in appearance. The disk is formed from two congruent ends that are attached by a lateral face. The sum of the surface areas of two congruent ends of the prism-shaped object that forms the disk is greater than the surface area of the lateral face of the prism-shaped object that forms the disk. In this disclosure, the congruent ends of the prism-shaped structure that forms the disk are referred to as the faces of the disk.

Elevation: As used in this disclosure, elevation refers to the span of the distance in the superior direction between a specified horizontal surface and a reference horizontal surface. Unless the context of the disclosure suggest otherwise, the specified horizontal surface is the supporting surface the potential embodiment of the disclosure rests on. The infinitive form of elevation is to elevate.

Exterior: As used in this disclosure, the exterior is used as a relational term that implies that an object is not contained within the boundary of a structure or a space.

Force of Gravity: As used in this disclosure, the force of gravity refers to a vector that indicates the direction of the pull of gravity on an object at or near the surface of the earth.

Flush: As used in this disclosure, the term flush is used to describe a first surface and a second surface that are geometrically identical such that the first surface and the second surface can be placed against each other to from a single aligned structure. The single aligned structure is selected from the group consisting of a Euclidean plane and a non-Euclidean plane.

Form Factor: As used in this disclosure, the term form factor refers to the size and shape of an object. 2

Furcate: As used in this disclosure, to furcate or furcation refers to the division of an object into a plurality branches, pieces, spaces, or segments.

Geometrically Similar: As used in this disclosure, geometrically similar is a term that compares a first object to a second object wherein: 1) the sides of the first object have a one to one correspondence to the sides of the second object; 2) wherein the ratio of the length of each pair of corresponding sides are equal; 3) the angles formed by the first object have a one to one correspondence to the angles of the second object; and, 4) wherein the corresponding angles are equal. The term geometrically identical refers to a situation where the ratio of the length of each pair of corresponding sides equals 1. By the term essentially geometrically similar is meant that the primary shapes of two objects are geometrically similar except that there are functional items (such as fastening devices) associated with the primary shape may not maintain the ratio for geometric similarity. By the term roughly geometrically similar is meant that the form factors between the primary shape of the two objects can vary by a factor of up to 10% when the two objects are normalized to be roughly geometrically identical.

Hook and Loop Fastener: As used in this disclosure, a hook and loop fastener is a fastener that comprises a hook surface and a loop surface. The hook surface comprises a plurality of minute hooks. The loop surface comprises a surface of uncut pile that acts like a plurality of loops. When the hook surface is applied to the loop surface, the plurality of minute hooks fastens to the plurality of loops securely fastening the hook surface to the loop surface. A note on usage: when fastening two objects the hook surface of a hook and loop fastener will be placed on the first object and the matching loop surface of a hook and loop fastener will be placed on the second object without significant regard to which object of the two objects is the first object and which of the two objects is the second object. When the hook surface of a hook and loop fastener or the loop surface of a hook and loop fastener is attached to an object this will simply be referred to as the "hook/loop surface" with the understanding that when the two objects are fastened together one of the two objects will have a hook surface and the remaining object will have the loop surface. Horizontal: As used in this disclosure, horizontal is a directional term that refers to a direction that is either: 1) parallel to the horizon; 2) perpendicular to the local force of gravity, or, 3) parallel to a supporting surface. In cases where the appropriate definition or definitions are not obvious, the second option should be used in interpreting the specification. Unless specifically noted in this disclosure, the horizontal direction is always perpendicular to the vertical direction.

Inferior: As used in this disclosure, the term inferior refers to a directional reference that is parallel to and in the same direction as the force of gravity when an object is positioned or used normally.

Interior: As used in this disclosure, the interior is used as a relational term that implies that an object is contained within the boundary of a structure or a space.

Lateral Disk Structure: As used in this disclosure, a lateral plate structure refers to the juxtaposition of a first lateral face of a first disk-shaped structure to a second lateral face of a second disk-shaped structure such that: a) the center axes of the first disk and the second disk are parallel; and, b) the congruent ends of the first disk are parallel to the congruent ends of the second disk. The span of the length of the center axes of the first disk and the second disk need not be equal. The form factor of the congruent ends of the first disk and the second disk need not be geometrically similar.

Lateral Prism Structure: As used in this disclosure, a lateral prism structure refers to the juxtaposition of a first lateral face of a first prism structure to a second lateral face of a second prism structure such that: a) the center axes of the first prism and the second prism are parallel; and, b) the congruent ends of the first prism are parallel to the congruent ends of the second prism. The span of the length of the center axes of the first prism and the second prism need not be equal. The form factor of the congruent ends of the first prism and the second prism need not be geometrically similar.

Load: As used in this disclosure, the term load refers to an object upon which a force is acting or which is otherwise absorbing energy in some fashion. Examples of a load in this sense include, but are not limited to, a mass that is being moved a distance or an electrical circuit element that draws energy. The term load is also commonly used to refer to the forces that are applied to a stationary structure.

Load Path: As used in this disclosure, a load path refers to a chain of one or more structures that transfers a load generated by a raised structure or object to a foundation, supporting surface, or the earth.

Major and Minor Axes: As used in this disclosure, the major and minor axes refer to a pair of perpendicular axes that are defined within a structure. The length of the major axis is always greater than or equal to the length of the minor axis. The major axis forms the longest symmetric bifurcation of a structure selected from the group consisting of: a) the structure; or, b) the perimetrical boundary of the structure. The major and minor axes intersect at the center of the structure. The major axis is always parallel or perpendicular to an edge of a rectangular or rectilinear structure.

Mattress: As used in this disclosure, a mattress is a disk-shaped structure that forms a cushion used by a patient when lying flat. The superior congruent end of the disk structure of the mattress forms a horizontally oriented surface.

Negative Space: As used in this disclosure, negative space is a method of defining an object through the use of open or empty space as the definition of the object itself, or, through the use of open or empty space to describe the boundaries of an object.

One to One: When used in this disclosure, a one to one relationship means that a first element selected from a first set is in some manner connected to only one element of a second set. A one to one correspondence means that the one to one relationship exists both from the first set to the second set and from the second set to the first set. A one to one fashion means that the one to one relationship exists in only one direction.

Pan: As used in this disclosure, a pan is a hollow and prism-shaped containment structure. The pan has a single open face. The open face of the pan is often, but not always, the superior face of the pan. The open face is a surface selected from the group consisting of: a) a congruent end of the prism structure that forms the pan; and, b) a lateral face of the prism structure that forms the pan. A semi-enclosed pan refers to a pan wherein the closed end of prism structure of the pan and/or a portion of the closed lateral faces of the pan are open.

Patient: As used in this disclosure, a patient is a person who is designated to receive a medical treatment, therapy, or service. The term patient may be extended to an animal when used within the context of the animal receiving veterinary treatment or services.

Perimeter: As used in this disclosure, a perimeter is one or more curved or straight lines that bounds an enclosed area on a plane or surface. The perimeter of a circle is commonly referred to as a circumference.

Perimetrical Boundary: As used in this disclosure, a perimetrical boundary is a hypothetical rectangular block that contains an object. Specifically, the rectangular block selected to be the perimetrical boundary is the rectangular block with the minimum volume that fully contains the object. In a two-dimensional structure, the perimetrical boundary is the rectangle with the minimum surface area.

Primary Shape: As used in this disclosure, the primary shape refers to a description of the rough overall geometric shape of an object that is assembled from multiple components or surfaces. The term essential primary shape is used to indicate the exclusion of functional items that are attached to the structure of the primary shape.

Primary Structure: As used in this disclosure, a primary structure refers to the component of an object that the other components attach to. The primary structure is also called the base structure.

Prism: As used in this disclosure, a prism is a three-dimensional geometric structure wherein: 1) the form factor of two faces of the prism are congruent; and, 2) the two congruent faces are parallel to each other. The two congruent faces are also commonly referred to as the ends of the prism. The surfaces that connect the two congruent faces are called the lateral faces. In this disclosure, when further description is required a prism will be named for the geometric or descriptive name of the form factor of the two congruent faces. If the form factor of the two corresponding faces has no clearly established or well-known geometric or descriptive name, the term irregular prism will be used. The center axis of a prism is defined as a line that joins the center point of the first congruent face of the prism to the center point of the second corresponding congruent face of the prism. The center axis of a prism is otherwise analogous to the center axis of a cylinder. A prism wherein the ends are circles is commonly referred to as a cylinder.

Superior: As used in this disclosure, the term superior refers to a directional reference that is parallel to and in the opposite direction of the force of gravity when an object is positioned or used normally.

Supporting Surface: As used in this disclosure, a supporting surface is a horizontal surface upon which an object is placed and to which the load of the object is transferred. This disclosure assumes that an object placed on the supporting surface is in an orientation that is appropriate for the normal or anticipated use of the object.

Textile: As used in this disclosure, a textile is a material that is woven, knitted, braided or felted. Synonyms in common usage for this definition include fabric and cloth. The two surfaces of the textile with the greatest surface area are called the faces of the textile.

Therapeutic: As used in this disclosure, therapeutic is an adjective that refers to a medical, ameliorative, or hygienic substance, process, procedure, or device.

Truncated: As used in this disclosure, a geometric object is truncated when an apex, vertex, or end is cut off by a line 2 or plane.

Vertex: As used in this disclosure, a vertex (plural vertices) is an angle that is formed by two lines that form a point. Vertices are commonly found in polygons.

Vertical: As used in this disclosure, vertical refers to a direction that is either: 1) perpendicular to the horizontal direction; 2) parallel to the local force of gravity; or, 3) when referring to an individual object the direction from the designated top of the individual object to the designated bottom of the individual object. In cases where the appropriate definition or definitions are not obvious, the second option should be used in interpreting the specification. Unless specifically noted in this disclosure, the vertical direction is always perpendicular to the horizontal direction.

With respect to the above description, it is to be realized that the optimum dimensional relationship for the various components of the invention described above and in FIGS. 1 through 5 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. An improved bed mattress comprising a mattress structure and a plurality of fastening devices;

wherein the mattress structure forms a multi-component structure of the improved bed mattress;

wherein the plurality of fastening devices attach the individual components of the multi-component structure of the improved bed mattress to each other;

wherein the mattress structure comprises a plurality of truncated mattress substructures and a core mattress substructure;

wherein the plurality of truncated mattress substructures removably attach to the core mattress substructure;

wherein the plurality of fastening devices comprises a first hook and loop fastener and a second hook and loop fastener;

wherein the first hook and loop fastener removably attaches a first truncated mattress substructure of the plurality of truncated mattress substructures to a surface of a first truncated surface of the core mattress substructure;

wherein the second hook and loop fastener removably attaches a second truncated mattress substructure of the plurality of truncated mattress substructures to a surface of a second truncated surface of the core mattress substructure;

wherein the improved bed mattress is a multi-component mattress;

wherein the improved bed mattress is configured for use in a chamber;

wherein the improved bed mattress is a configurable structure;

wherein by configurable is meant that the form factor of the improved bed mattress is adjustable;

wherein the improved bed mattress can be configured to fit into a corner of the chamber such that the improved bed mattress fits flush against surfaces of the walls that form the brink of the corner of the chamber;

wherein the mattress structure forms a horizontally oriented supporting surface;

wherein the mattress structure forms a cushioned surface;

wherein the mattress structure forms the multi-component mattress structure of the improved bed mattress;

wherein the fully assembled mattress structure forms a disk structure;

wherein the fully assembled mattress structure forms a lateral disk structure;

wherein the fully assembled mattress structure has a rectangular disk shape;

wherein each truncated mattress substructure selected from the plurality of truncated mattress substructures forms a horizontally oriented supporting surface;

wherein each selected truncated mattress substructure forms a cushioned surface;

wherein each selected truncated mattress substructure is a disk shaped structure;

wherein each selected truncated mattress substructure removably attaches to the core mattress substructure to form a lateral disk structure;

wherein each selected truncated mattress substructure has a triangular shape;

wherein each selected truncated mattress substructure is formed from the bifurcation of a vertex of the rectangular disk shape of the mattress structure;

wherein the selected truncated mattress substructure is formed from the truncation of the vertex of the mattress structure;

wherein the full rectangular disk structure of the mattress structure is formed when all the truncated mattress substructures selected from the plurality of truncated mattress substructures are attached to the mattress structure;

wherein the form factor of the mattress structure adjusts by adding and removing one or more truncated mattress substructures selected from the plurality of truncated mattress substructures to the mattress structure.

2. The improved bed mattress according to claim 1 wherein the core mattress substructure forms a horizontally oriented supporting surface;

wherein the core mattress substructure forms a cushioned surface;

wherein the core mattress substructure is a disk shaped structure;

wherein the core mattress substructure has an irregular disk shape;

wherein the core mattress substructure is formed with an apex;

wherein the apex of the core mattress substructure allows the core mattress substructure to fit into the corner of the chamber such that a subset of the lateral faces of the disk structure of the core mattress substructure fit flush against the walls that form the brink of the corner of the chamber.

3. The improved bed mattress according to claim 2 wherein the core mattress substructure further comprises the first truncated surface and the second truncated surface;

wherein the first truncated surface is a lateral face of the disk structure of the core mattress substructure;

wherein the first truncated surface is the face of the core mattress substructure that is formed by furcated separation of the first truncated mattress substructure from the core mattress substructure;

wherein the second truncated surface is a lateral face of the disk structure of the core mattress substructure;

wherein the second truncated surface is the face of the core mattress substructure that is formed by furcated separation of the second truncated mattress substructure from the core mattress substructure;

wherein the plurality of fastening devices comprises a collection of fastening devices;

wherein each plurality of fastening devices removably attaches the plurality of truncated mattress substructures to the core mattress substructure;

wherein the form factor of the mattress structure adjusts by adding and removing one or more truncated mattress substructures selected from the plurality of truncated mattress substructures to the core mattress substructure;

wherein the plurality of fastening devices attaches each selected truncated mattress substructure to the core mattress substructure to form the lateral disk structure of the mattress structure.

4. The improved bed mattress according to claim 3 wherein the first truncated mattress substructure forms a horizontally oriented supporting surface;

wherein the first truncated mattress substructure forms a cushioned surface;

wherein the first truncated mattress substructure is a disk shaped structure;

wherein the first truncated mattress substructure has a triangular shape;

wherein the first truncated mattress substructure removably attaches to the core mattress substructure to form a lateral disk structure;

wherein the first truncated mattress substructure changes the form factor of the mattress structure when the first truncated mattress substructure attaches to the core mattress substructure;

wherein the first truncated mattress substructure changes the form factor of the mattress structure when the first truncated mattress substructure is removed from the core mattress substructure;

wherein the second truncated mattress substructure forms a horizontally oriented supporting surface;

wherein the second truncated mattress substructure forms a cushioned surface;

wherein the second truncated mattress substructure is a disk shaped structure;

wherein the second truncated mattress substructure has a triangular shape;

wherein the second truncated mattress substructure removably attaches to the core mattress substructure to form a lateral disk structure;

wherein the second truncated mattress substructure changes the form factor of the mattress structure when the second truncated mattress substructure attaches to the core mattress substructure;

wherein the second truncated mattress substructure changes the form factor of the mattress structure when the second truncated mattress substructure is removed from the core mattress substructure.

5. The improved bed mattress according to claim 4 wherein the first truncated mattress substructure further comprises a third truncated surface;

wherein the third truncated surface is a lateral face of the disk structure of the first truncated mattress substructure;

wherein the third truncated surface is the face of the first truncated mattress substructure that is formed by the furcation of the first truncated mattress substructure from the rectangular disk structure of the assembled mattress structure;

wherein the second truncated mattress substructure further comprises a fourth truncated surface;

wherein the fourth truncated surface is a lateral face of the disk structure of the second truncated mattress substructure;

wherein the fourth truncated surface is the face of the second truncated mattress substructure that is formed by the furcation of the second truncated mattress substructure from the rectangular disk structure of the assembled mattress structure.

6. The improved bed mattress according to claim 5 wherein the first hook and loop fastener is a fastening device selected from the plurality of fastening devices;

wherein the first hook and loop fastener is a hook and loop fastener;

wherein the first hook and loop fastener further comprises a first hook/loop surface and a second hook/loop surface;

wherein the first hook/loop surface is a hook/loop surface associated with the first hook and loop fastener;

wherein the first hook/loop surface permanently attaches to the third truncated surface of the first truncated mattress substructure;

wherein the second hook/loop surface is a hook/loop surface associated with the first hook and loop fastener;

wherein the second hook/loop surface permanently attaches to the first truncated surface of the core mattress substructure;

wherein the first hook and loop fastener attaches the first truncated surface to the third truncated surface by pressing the first hook/loop surface into the second hook/loop surface;

wherein the second hook and loop fastener is a fastening device selected from the plurality of fastening devices;

wherein the second hook and loop fastener is a hook and loop fastener;

wherein the second hook and loop fastener further comprises a third hook/loop surface and a fourth hook/loop surface;

wherein the third hook/loop surface is a hook/loop surface associated with the second hook and loop fastener;

wherein the third hook/loop surface permanently attaches to the fourth truncated surface of the second truncated mattress substructure;

wherein the fourth hook/loop surface is a hook/loop surface associated with the second hook and loop fastener;

wherein the fourth hook/loop surface permanently attaches to the second truncated surface of the core mattress substructure;

wherein the second hook and loop fastener attaches the second truncated surface to the fourth truncated surface by pressing the third hook/loop surface into the fourth hook/loop surface.

* * * * *